US007061187B2

(12) United States Patent
Moisin

(10) Patent No.: US 7,061,187 B2
(45) Date of Patent: Jun. 13, 2006

(54) CIRCUIT HAVING CLAMPED GLOBAL FEEDBACK FOR LINEAR LOAD CURRENT

(76) Inventor: Mihail S. Moisin, 8 Druce St., Brookline, MA (US) 02445

( * ) Notice: Subject to any disclaimer, the term of this patent is extended or adjusted under 35 U.S.C. 154(b) by 301 days.

(21) Appl. No.: 10/780,926

(22) Filed: Feb. 18, 2004

(65) Prior Publication Data

US 2005/0237003 A1 Oct. 27, 2005

Related U.S. Application Data

(63) Continuation-in-part of application No. 10/685,781, filed on Oct. 15, 2003, now Pat. No. 6,954,036.

(60) Provisional application No. 60/455,752, filed on Mar. 19, 2003.

(51) Int. Cl.
*H05B 37/00* (2006.01)

(52) U.S. Cl. ..... 315/224; 315/274; 315/307

(58) Field of Classification Search ..... 315/224, 315/307

See application file for complete search history.

(56) References Cited

U.S. PATENT DOCUMENTS

| | | | |
|---|---|---|---|
| 3,859,555 A | | 1/1975 | Latassa et al. |
| 4,580,013 A | | 4/1986 | Moisin |
| 4,829,567 A | | 5/1989 | Moisin |
| 4,864,609 A | | 9/1989 | Moisin |
| 4,922,531 A | | 5/1990 | Moisin |
| 5,014,305 A | | 5/1991 | Moisin |
| 5,052,039 A | | 9/1991 | Moisin |
| 5,081,401 A | | 1/1992 | Moisin |
| 5,124,619 A | | 6/1992 | Moisin et al. |
| 5,138,233 A | | 8/1992 | Moisin et al. |
| 5,138,234 A | | 8/1992 | Moisin |
| 5,138,236 A | | 8/1992 | Bobel et al. |
| 5,144,195 A | | 9/1992 | Konopka et al. |
| 5,148,087 A | | 9/1992 | Moisin et al. |
| 5,220,247 A | | 6/1993 | Moisin |
| 5,332,951 A | | 7/1994 | Turner et al. |
| 5,583,402 A | | 12/1996 | Moisin et al. |
| 5,608,295 A | | 3/1997 | Moisin |
| 5,686,799 A | | 11/1997 | Moisin et al. |
| 5,691,606 A | | 11/1997 | Moisin et al. |
| 5,798,617 A | | 8/1998 | Moisin |
| 5,821,699 A | | 10/1998 | Moisin |
| 5,866,993 A | | 2/1999 | Moisin |
| 5,877,926 A | | 3/1999 | Moisin |
| 5,925,986 A | | 7/1999 | Moisin |
| 5,955,841 A | | 9/1999 | Moisin et al. |
| 5,982,111 A | | 11/1999 | Moisin |
| 6,011,362 A | | 1/2000 | Moisin |
| 6,020,688 A | | 2/2000 | Moisin |
| 6,028,399 A | | 2/2000 | Moisin |
| 6,037,722 A | | 3/2000 | Moisin |
| 6,051,936 A | | 4/2000 | Qian |
| 6,057,652 A | * | 5/2000 | Chen et al. ..... 315/307 |
| 6,069,455 A | | 5/2000 | Moisin |
| 6,091,288 A | | 7/2000 | Moisin |
| 6,100,645 A | | 8/2000 | Moisin |
| 6,100,648 A | | 8/2000 | Moisin |
| 6,107,750 A | | 8/2000 | Moisin |
| 6,122,182 A | | 9/2000 | Moisin |

(Continued)

*Primary Examiner*—David Vu
(74) *Attorney, Agent, or Firm*—Daly, Crowley, Mofford & Durkee, LLP

(57) ABSTRACT

A resonant circuit includes a clamped feedback signal for providing a load current signal envelope that substantially tracks an input signal. With this arrangement, circuit efficiency is enhanced by the linear operation of the circuit.

39 Claims, 16 Drawing Sheets

U.S. PATENT DOCUMENTS 6,127,786 A 10/2000 Moisin
6,137,233 A 10/2000 Moisin
6,157,142 A 12/2000 Moisin
6,160,358 A 12/2000 Moisin
6,169,375 B1 1/2001 Moisin
6,181,082 B1 1/2001 Moisin
6,181,083 B1 1/2001 Moisin
6,188,553 B1 2/2001 Moisin
6,194,843 B1 2/2001 Moisin
6,222,326 B1 4/2001 Moisin
6,236,168 B1 5/2001 Moisin
6,281,638 B1 8/2001 Moisin
6,674,246 B1 1/2004 Moisin
6,731,075 B1 * 5/2004 Pak ..... 315/274
2002/0011806 A1 1/2002 Moisin
2002/0030451 A1 3/2002 Moisin
2003/0160571 A1 8/2003 Moisin
2004/0090800 A1 5/2004 Moisin

* cited by examiner

| REF. DESIGN. | DESCRIPTION |
|---|---|
| L3 | Inductor Assy, 1.69mH (+/-3%), AL=100 |
| | 130T/10T, 3x33AWG Litz, 7pin, CS-L3 |
| L2 | Inductor Assy, 1.90mH, AL=65 |
| | 171T, 29AWGH, 5pin CS-L2 |
| L1 | Inductor Assy, 1.90mH, AL=65 |
| | 171T, 29AWGH, 5pin CS-L2 |
| T1 | Torroid Transformer, CS1 |
| | H40-T(9x4x5) (1-1-5)T |
| C3 | Capacitor, Ceramic, SMD, |
| | 0.1uF, 50Vdc, 10%, 1206 Pkg. |
| C1 | Capacitor, Metallized Polyester, 5mm |
| | 0.01uF, 400Vdc, 10% |
| C2 | Capacitor, Metallized Polyester, 5mm |
| | Epoxy-Dipped, 33nF, 250Vdc, 10% |
| C12 | Capacitor, Prypropylene, 5mm |
| | Epoxy-Dipped, 2.7nF, 400Vdc, 10% |
| C5 | Capacitor, Ceramic, Radial |
| | 100pF, 1000Vdc, 5mm |
| C8 | Capacitor, Prypropylene, 5mm |
| | Epoxy-Dipped, 2.2nF, 1500V, 10% |
| C10 | Capacitor, Prypropylene, 5mm |
| | Epoxy-Dipped, 4.7nF, 400Vdc, 10% |
| CO1, CO2 | Capacitor, Electrolytic, (10x20)mm |
| | 33uF, 200Vdc, 105C, 5mm |
| D5 | Diode, Axial, Glass-Passivated |
| | Fast, 1000V, 1N4007GP |
| D1-D4, D9-D10 | Diode, Axial, Glass-Passivated |
| | Ultra-Fast, 1000V, UF4007GP |
| D6 | Diac, Axial, 32V Db-3 |
| RF | Fuse, Axial |
| | 3A/250V |
| R7, R15 | Resistor, SMD, 1206 Pkg, |
| | 0 Ohm |
| R8, R11, R12 | Resistor, SMD, 1206 Pkg, |
| R14, R20, R21 | 0 Ohm |
| R6, R10, R13, R16 | Resistor, SMD, 1206 Pkg, |
| NOT USED | |
| R3 | Resistor, SMD, 1206 Pkg, |
| | 33 Ohm, 5%, 1/4W |
| R5, R9 | Resistor, SMD, 1206 Pkg, |
| | 20 Ohm, 1%, 1/4W |
| R1, R2 | Resistor, SMD, 1206 Pkg, |
| | 150 kOhm, 5%, 1/4W |
| R4 | Resistor, SMD, 1206 Pkg, |
| | 300 kOhm, 5%, 1/4W |
| R17-R19 | Resistor, SMD, 1206 Pkg, |
| NOT USED | |
| Q1, Q2 | Transistor Power, TO-220 |
| | ST13005 |
| J1, J1 | Terminal, Radial |
| | 2 pin, CSI |
| TH1 | Thermister, PTC |
| NOT USED | |

*FIG. 17*

CIRCUIT HAVING CLAMPED GLOBAL FEEDBACK FOR LINEAR LOAD CURRENT

CROSS REFERENCE TO RELATED APPLICATION

The present application is a continuation-in-part of and claims the benefit of U.S. patent application Ser. No. 10/685,781 filed on Oct. 15, 2003, now U.S. Pat. No. 6,954,036 which claims the benefit of U.S. Provisional Patent Application No. 60/455,752, filed on Mar. 19, 2003, all of which are incorporated herein by reference.

STATEMENT REGARDING FEDERALLY SPONSORED RESEARCH

Not Applicable.

FIELD OF THE INVENTION

The present invention relates generally to electrical circuits and, more particularly, to electrical circuits for controlling power to a load.

BACKGROUND OF THE INVENTION

As is known in the art, there are a variety of circuits for energizing a load that attempt to improve the overall circuit performance. Some circuits utilize feedback from a load to bias components, such as diodes, to the conductive state to enable more efficient charging of storage capacitors, for example. Exemplary power control, dimming, and/or feedback circuits are shown and described in U.S. Pat. Nos. 5,686,799, 5,691,606, 5,798,617, and 5,955,841, all of which are incorporated herein by reference.

FIG. 1 shows an exemplary prior art resonant circuit having a feedback path FB via a series capacitor Cs to a point PFB between diodes D1, D2 that form a voltage doubler circuit. An input filter IF includes an inductor L1 and a capacitor C1 to limit the energy from the resonant circuit that goes back out on the line via the input terminals, which can correspond to conventional white and black wires WHT, BLK. While the voltage level of the feedback signal applied to the diodes D1, D2 can be increased by resonance between the various LC elements CF, LR1, LR2, the amount of feedback is limited to an acceptable amount of electromagnetic interference generated by a portion of the feedback signal flowing back out through the input inductor L1 and capacitor C1. That is, some known circuits having feedback from the load can generate significant Electromagnetic Conductive interference (EMC) that degrades circuit performance and limits use of the feedback.

It would, therefore, be desirable to overcome the aforesaid and other disadvantages.

SUMMARY OF THE INVENTION

The present invention provides a resonant circuit using feedback from a load to promote linear operation of rectifying diodes while limiting electromagnetic conduction interference from the feedback signal. With this arrangement, a clamped amount of the high frequency load feedback signal can be used to maintain rectifying diodes in a conductive state so as to make non-linear loads appear linear. While the invention is primarily shown and described in conjunction with a ballast circuit energizing a fluorescent lamp, it is understood that the invention is applicable to circuits in general in which a feedback signal can enhance circuit performance.

In one embodiment, a circuit includes first and second input terminals for receiving an AC input signal and an input inductor having a first end coupled to the first terminal. The circuit further includes a feedback path for transferring a signal from a load to a second end of the first inductor and a blocking capacitor coupled in parallel with the input inductor so as to form a notch filter tuned to a frequency of the load signal on the feedback path. With this arrangement, the entire load current can be provided as feedback to rectifying diodes to promote linear operation of the diodes while the notch filter blocks energy from the feedback signal from going back out onto the line.

In another aspect of the invention, a circuit, such as a resonant ballast circuit, includes a load inductor inductively coupled to a resonant inductor and a Positive Temperature Coefficient (PTC) element that combine to provide a soft start for a load, which can correspond to a fluorescent lamp.

In a further aspect of the invention, a resonant circuit includes a clamped feedback signal for providing a load current signal envelope that substantially tracks an input signal. With this arrangement, circuit efficiency is enhanced by the linear operation of the circuit.

BRIEF DESCRIPTION OF THE DRAWINGS

The invention will be more fully understood from the following detailed description taken in conjunction with the accompanying drawings, in which:

FIG. 17 is a textual representation showing exemplary component values for the circuit of FIG. 16;

DETAILED DESCRIPTION OF THE INVENTION

Figure 1:
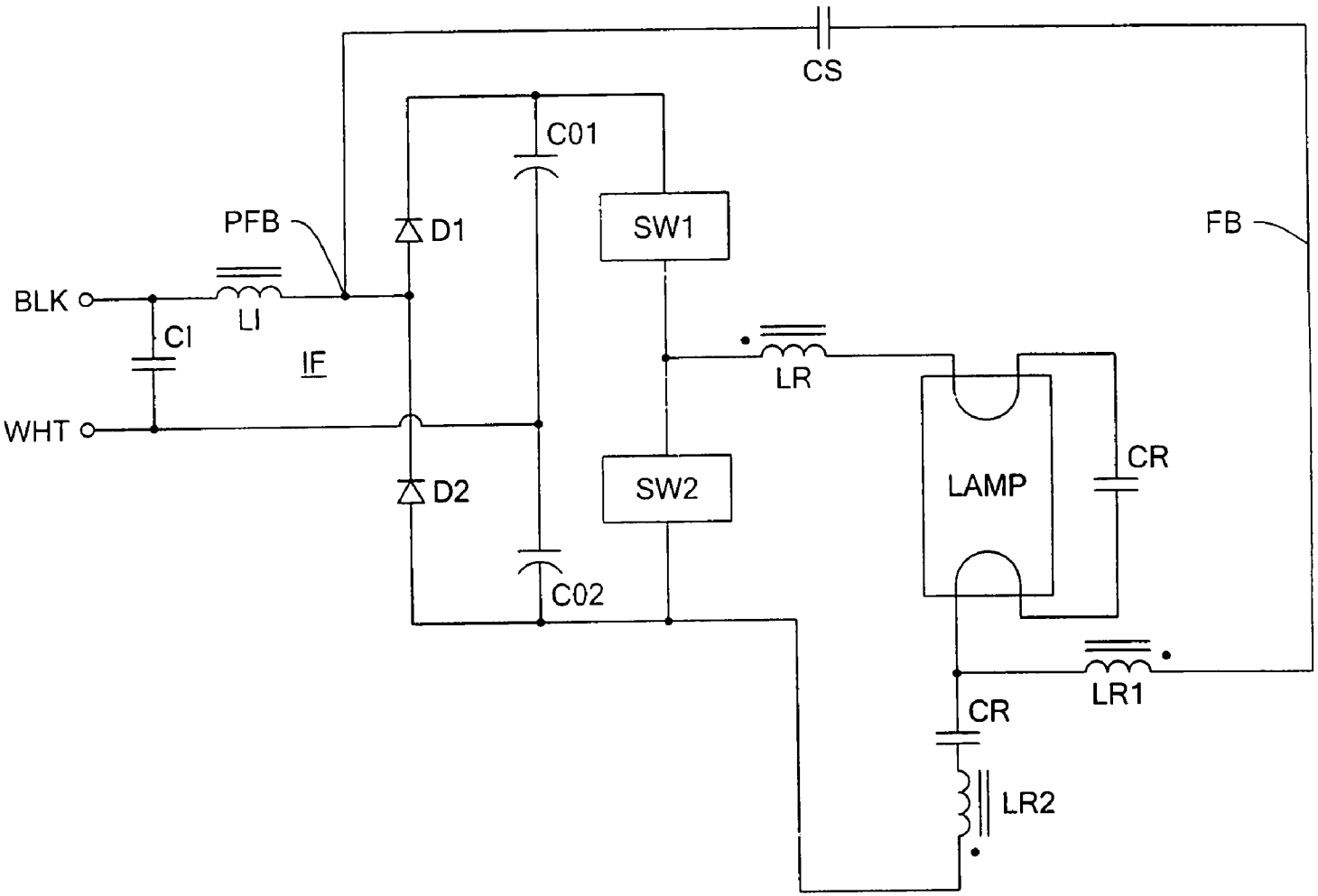
FIG. 1 (PRIOR ART)
FIG. 1 is a schematic diagram of a prior art circuit having feedback from a load.
Figure 2:
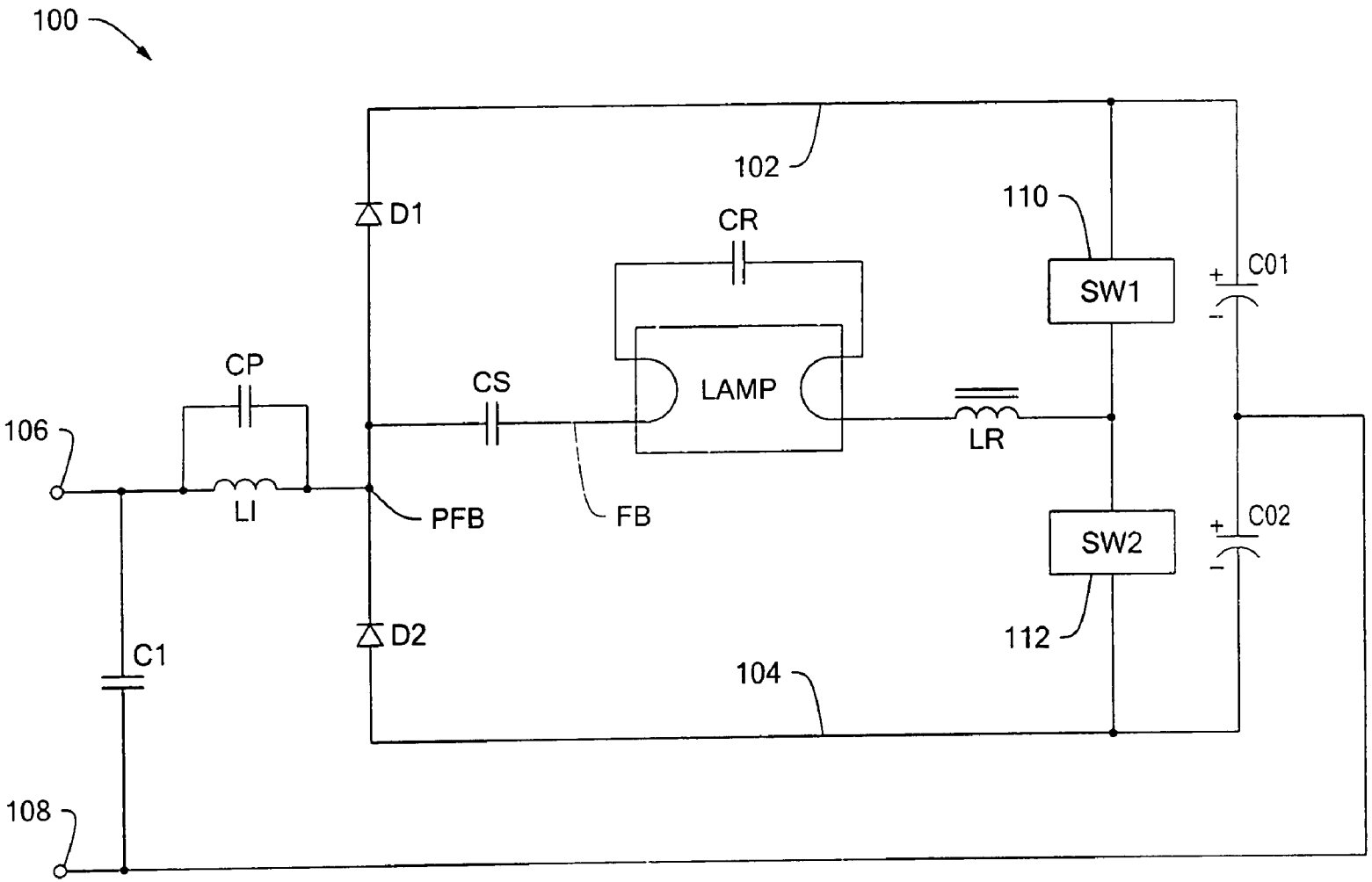
FIG. 2 is a schematic depiction of a circuit having a feedback path in accordance with the present invention.

FIG. 2 shows an exemplary circuit 100 having a feedback path FB from the load LD, here shown as a fluorescent lamp (a non-linear load), to a point PFB between first and second diodes D1, D2 coupled across first and second rails 102, 104 in a voltage doubler configuration. The feedback path FB can include a series capacitor CS coupled between the load LD and the feedback point PFB.

First and second storage capacitors C01, C02 are coupled end-to-end across the rails 102, 104. A first input terminal 106, which can correspond to a conventional black wire, is coupled via an input inductor L1 to the feedback point PFB between the diodes D1, D2. A second input terminal 108, which can correspond to a conventional white wire, is coupled to a point between the first and second capacitors C01, C02. An input capacitor C1 can be coupled between the first and second terminals 106, 108.

In one particular embodiment, the resonant circuit 100 includes first and second switching elements 110, 112 coupled in a half bridge configuration for energizing a load. The resonant circuit 100 includes a resonant inductor LR, a resonant capacitor CR, and a load LD, such as a fluorescent lamp. It is understood that the load can be provided from a wide variety of resonant and non-resonant, linear and non-linear circuits, devices and systems. It is further understood that the switching elements can be provided in a variety of topologies, such as full bridge arrangements, without departing from the present invention. In addition, the switching elements can be selected from a wide variety of device types well known to one of ordinary skill in the art.

The circuit 100 further includes a blocking capacitor CP coupled in parallel across the input inductor L1. The impedance of the blocking capacitor CP is selected to resonate in parallel with the input inductor L1 at a frequency representative of the feedback signal, which corresponds to an operating frequency of the load. The blocking capacitor CP and the input inductor L1 provide a notch filter at the frequency of the feedback signal so as to block energy from the feedback signal from going back out onto the line through the input terminals 106, 108. The notch filter allows minimal current flow from the feedback signal through the input capacitor C1 and input inductor L1.

Since the path back out onto the line is blocked, substantially all of the feedback signal energy, which can correspond to the entire load current, is directed to maintaining the diodes D1, D2 in a conductive state. The high frequency feedback signal biases the diodes D1, D2 to the conductive state, which facilitates the flow of energy from the line to the storage capacitors C01, C02. With this arrangement, a non-linear load appears to be linear.

Figure 3:
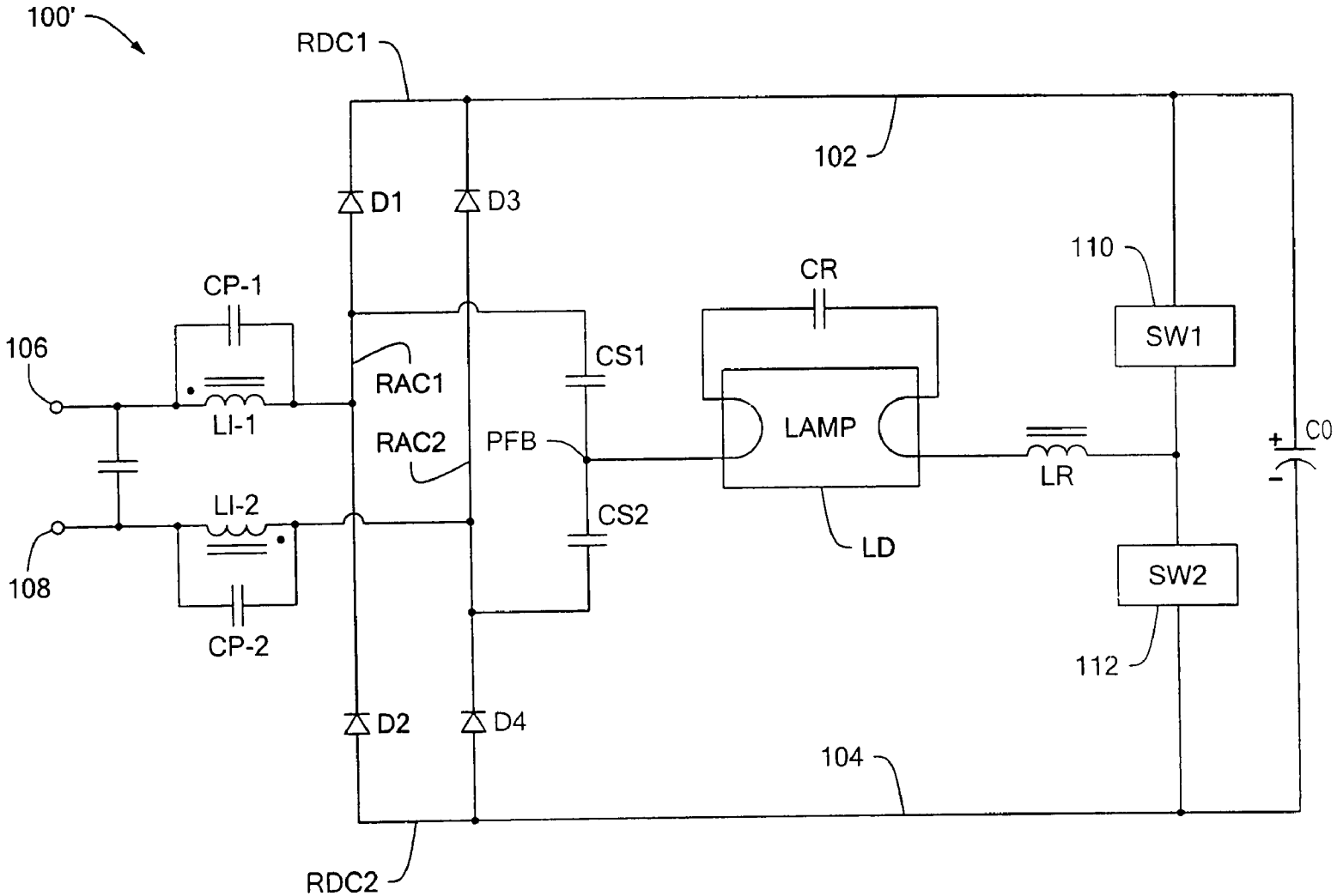
FIG. 3 is a schematic depiction of a further circuit having a feedback path in accordance with the present invention.

FIG. 3 shows another embodiment 100' having enhanced linear operation similar to that of FIG. 2, where like reference designations indicate like elements. The circuit 100' includes a full bridge rectifier D1, D2, D3, D4 having first and second series capacitors CS1, CS2 coupled end-to-end between AC terminals RAC1, RAC2 of the rectifier. A storage capacitor C0 is coupled across the DC rails RDC1, RDC2. A feedback path FB extends from the load LD, here shown as a lamp, to a point PFB between the first and second series capacitors C1, C2.

A first input inductor L1-1 is located at the first input terminal 106 and a second input inductor L1-2, which can be inductively coupled with the first input inductor L1-1, is located at the second input terminal 108. It is understood that the input inductors L1-1, L1-2 can be coupled or independent depending upon the needs of a particular application. A first blocking capacitor CP-1 is coupled in parallel with the first input inductor L1-1 to form a notch filter tuned to the feedback signal from the load LD. A second blocking capacitor CP-2 is coupled in parallel with the second input inductor L1-2 to also form a notch filter tuned to the feedback signal.

In one particular embodiment, the impedance of the first and second input inductors L1-2, L1-2 are substantially the same and the impedance of the first and second blocking capacitors CP-1, CP-2 is substantially the same.

With this arrangement, energy from the feedback signal FB is directed to maintaining the full bridge rectifier diodes D1-D4 in the conductive state since the notch filters L1-1, CP-1 and L1-2, CP-2 block energy from the feedback signal from going back out on the line and thereby minimize EMC levels.

Figure 4:
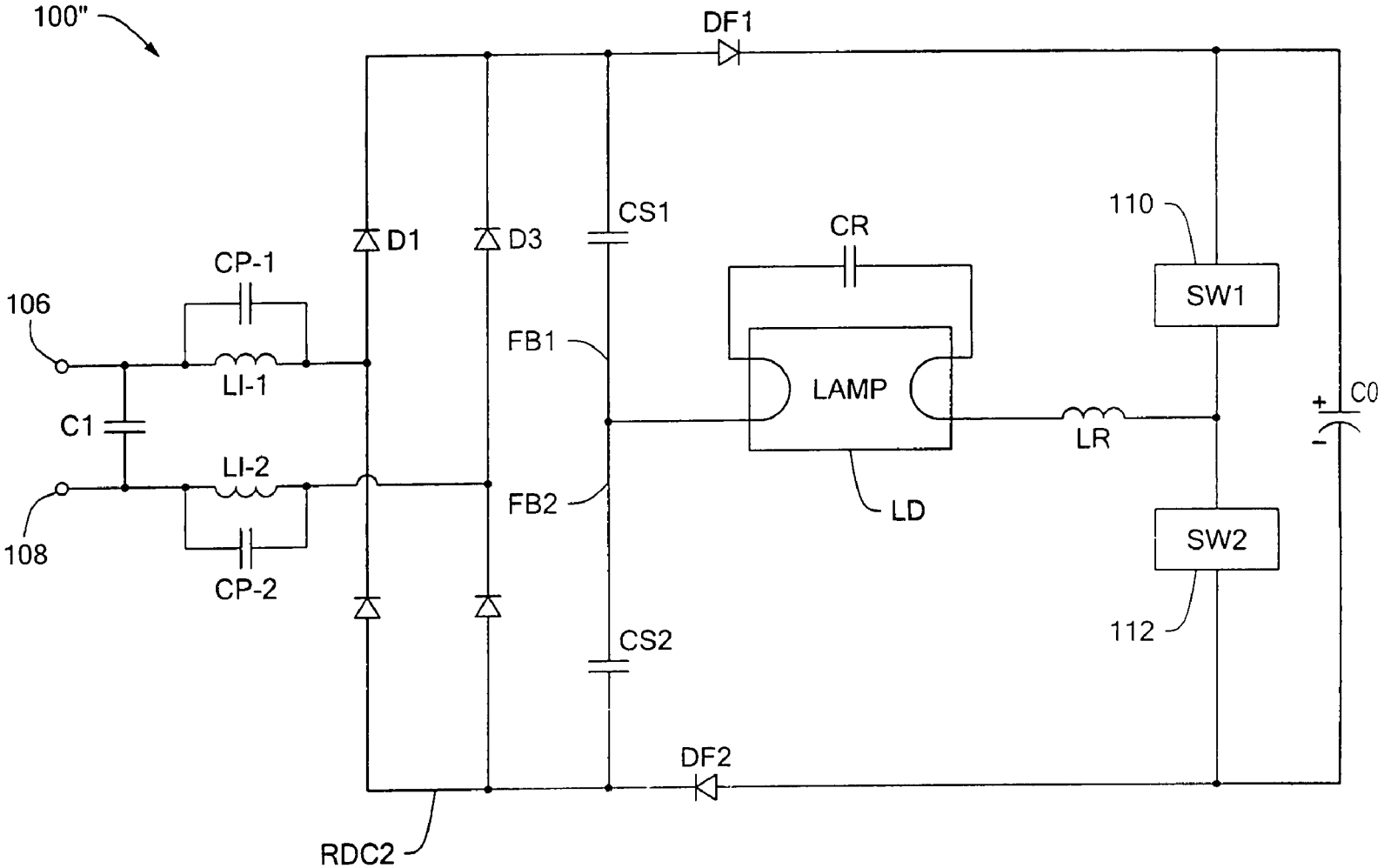
FIG. 4 is a schematic depiction of another circuit having a feedback path in accordance with the present invention.

FIG. 4 shows another embodiment 100" having enhanced linear operation similar to that of FIG. 3, where like reference designations indicate like elements. The circuit 100" includes first and second feedback paths FB1, FB2 from the load LD to respective first and second DC terminals RDC1, RDC2 of the full bridge rectifier D1-D4. The first feedback path FB1 includes a first series capacitor CS1 and the second feedback path FB2 includes a second series capacitor CS2. The circuit 100" further includes a first bridge diode DF1 coupled between the first feedback point RDC1 and the first switching element 110 and a second bridge diode DF2 coupled between second feedback point RDC2 and the second switching element 112.

With this arrangement, the entire feedback from the load can be provided to the rectifying diodes to promote linear operation of the rectifying diodes D1–D4. Notch filters provided by parallel LC resonant circuits tuned to a frequency representative of the feedback signal enable most of the load signal to be fed back, since the notch filter reduces the EMC energy going back out on the line to acceptable levels, even under applicable residential standards.

While the exemplary embodiments show a circuit having EMC-reducing notch filters as parallel resonant LC circuits, it is understood that other resonant circuits can be used to provide the notch filter.

In a further aspect of the invention, a ballast circuit includes a load inductor inductively coupled with a resonant inductor, a resonant capacitor, and a positive temperature coefficient (PTC) element, that combine to promote a soft start sequence for a lamp. With this arrangement preferred voltage and current start up levels are provided to a fluorescent lamp, for example.

Figure 5:
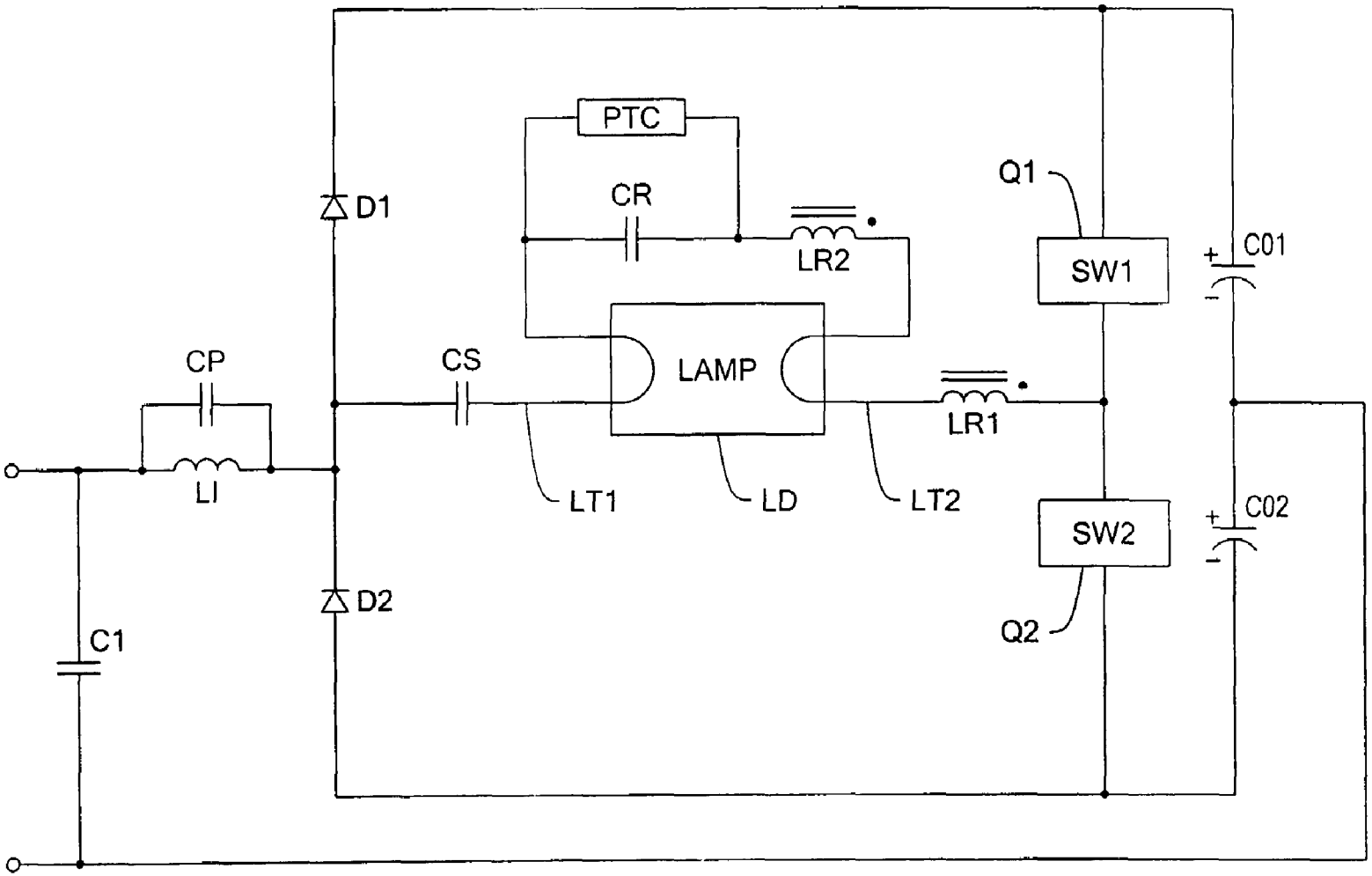
FIG. 5 is a schematic depiction of a circuit providing a soft start in accordance with the present invention.

FIG. 5 shows an exemplary resonant circuit 200, here shown as a ballast circuit, having a lamp start up sequence in accordance with the present invention. The circuit 200 includes a resonant inductor LR1 coupled between first and second switching elements Q1, Q2 coupled in a half-bridge topology. The circuit can further include a conventional input stage having voltage doubler diodes D1, D2, storage capacitors C01, C02, and an LC input filter.

It is understood that the circuit can include various topologies without departing from the present invention. It is further understood that the switching elements can be provided from a wide range of device types well known to one of ordinary skill in the art.

The exemplary circuit 200 further includes first and second load terminals LT1, LT2 across which a load LD, such as a fluorescent lamp, can be energized via a current flow. A resonant capacitor CR and a load inductor LR2 are coupled end-to-end across the first and second load terminals LT1, LT2. The load inductor LR2 is inductively coupled to the resonant inductor LR1. A PTC element PTC is coupled in parallel with the resonant capacitor CR.

Figure 6:
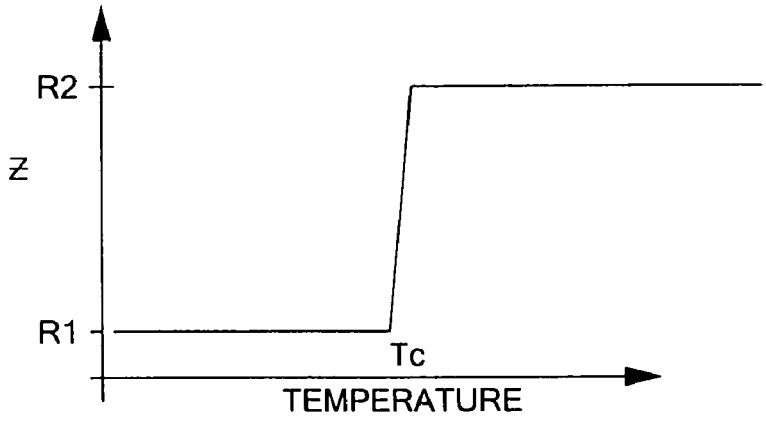
FIG. 6 is a graphical depiction of impedance versus temperature for a positive temperature coefficient element that can form a part of the circuit of FIG. 5.

As is shown in FIG. 6 and known in the art, a PTC element has a first (resistive) impedance R1 at a first (lower) temperature range and a second (resistive) impedance R2, which can be significantly higher than the first impedance, at a second (higher) temperature range. In general, at some temperature Tc the PTC impedance dramatically changes from the first impedance R1 to the second impedance R2. In an exemplary embodiment, the Tc for the PTC is about 120° C., the cold impedance is about 1 kOhm and the voltage rating is 350Vrms. One of ordinary skill in the art will readily appreciate that PTC characteristics can be selected to meet the needs of a particular application.

Figure 7A:
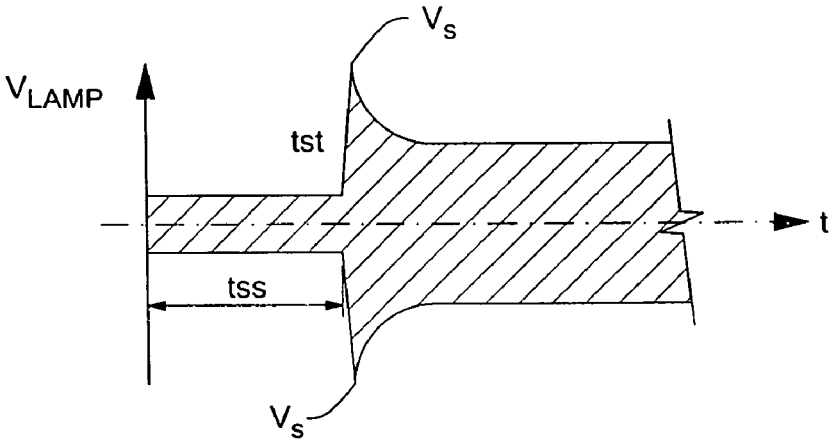
FIG. 7A is a graphical depiction of lamp voltage provided by the circuit of FIG. 5.
Figure 7B:
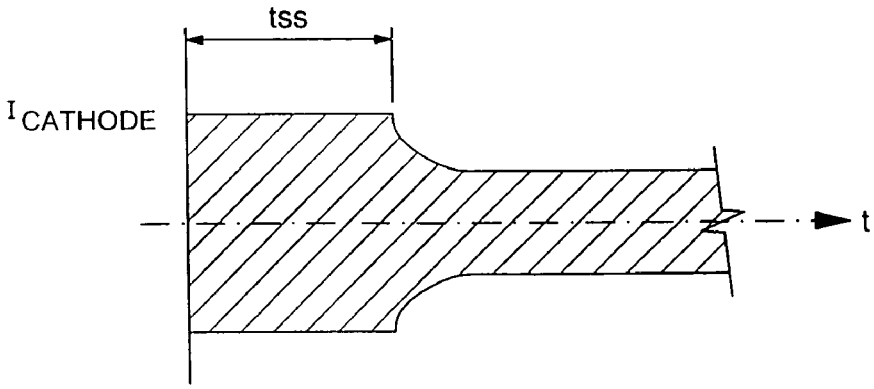
FIG. 7B is a graphical depiction of lamp cathode current provided by the circuit of FIG. 5.

As shown in FIG. 7A, a relatively low voltage Vlamp is applied to the lamp for a soft start time tss and a relatively high initial cathode current level Icathode, which can be referred to as a glow current, simultaneously flows through the lamp cathodes to warm them up for the soft start time tss, e.g., about 0.5 seconds, as shown in FIG. 7B. After the soft start time, the positive temperature coefficient element PTC warms up to the predetermined temperature Tc so that the PTC impedance increases to the second higher level R2. As the PTC element impedance rises dramatically to approach an open circuit characteristic, a strike voltage Vs is applied to the lamp. After the strike voltage is applied, operational lamp voltage Vlamp levels and cathode current Icathode levels are achieved.

The load inductor LR2 helps define the voltage across the lamp. It is well known that some loads, such as Compact Fluorescent Lamps (CFLs), have a relatively wide operating range. For example, while the current level may fall after dimming the lamp, the voltage across the lamp may not. As is also known, the load voltage has a natural tendency to increase as the operating frequency of the resonant circuit increases. The load inductor L2 resists this voltage elevation since its impedance rises with increases in frequency. Thus, the load inductor LR2 helps maintain a constant circuit operating frequency.

In another aspect of the invention, a resonant circuit includes a clamped feedback signal that provides a load current signal having an envelope substantially tracking an input signal. With this arrangement, the load current signal envelope tracks the input signal to promote linear operation and circuit efficiency even in the presence of storage capacitors.

Figure 8:
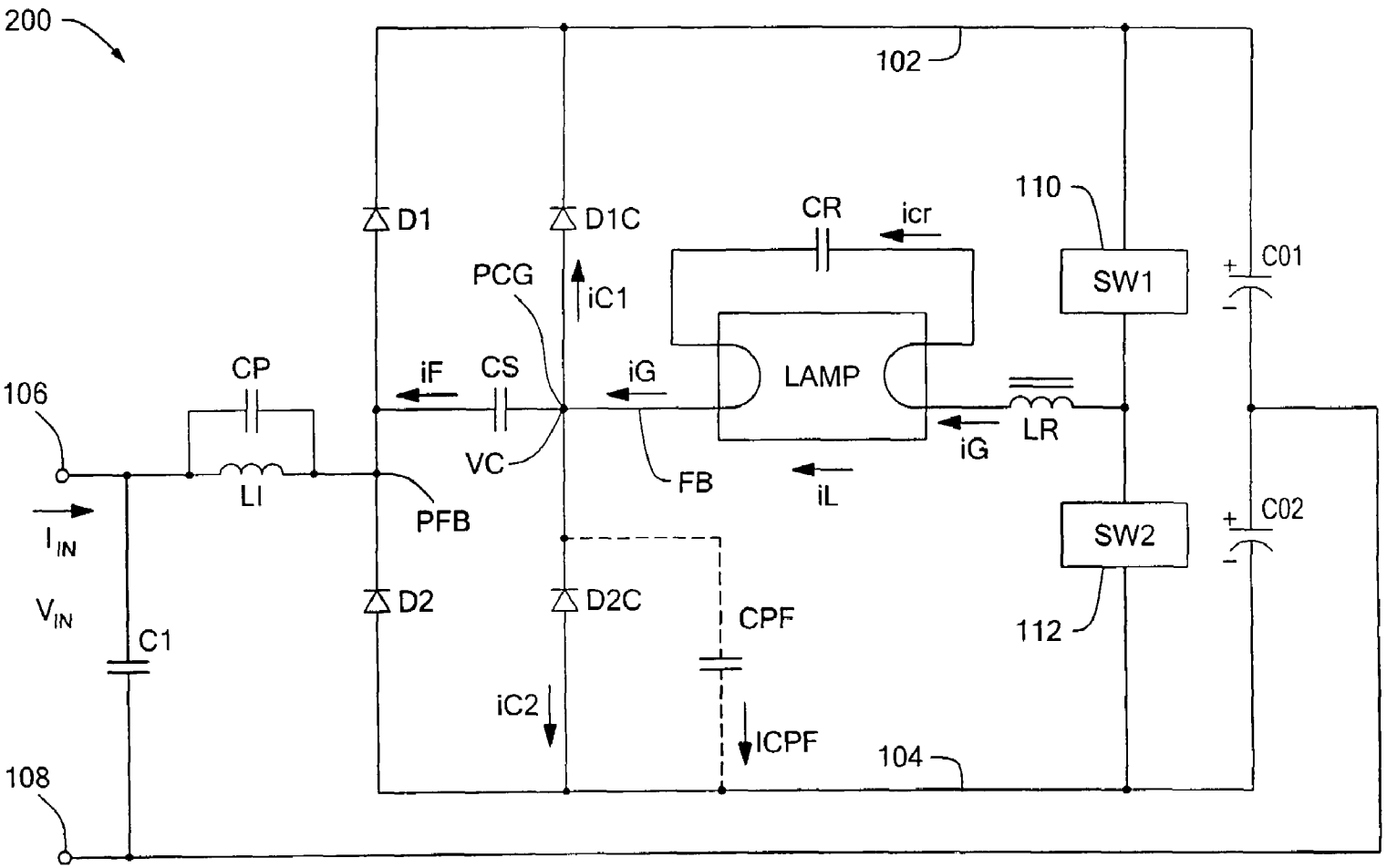
FIG. 8 is a schematic depiction of an exemplary circuit having clamped feedback in accordance with the present invention.

FIG. 8 shows an exemplary resonant circuit 200 having a linear load current signal in accordance with the present invention. FIG. 8 has some commonality with FIG. 2 where like reference numbers indicate like elements. FIG. 8 further includes first and second clamping diodes D1C, D2C coupled end-to-end across the voltage rails 102, 104. A point PCG between the first and second clamping diodes D1C, D2C forms a node between series capacitor CS and the lamp. The circuit 200 can further include an optional impedance, here shown as capacitor CPF, to adjust the feedback signal as described more fully below.

In operation, a global current iG flows through the resonant inductor LR and splits into a resonant capacitor current iCR and a load current iL though the lamp. Coming from the lamp the re-combined global current iG splits at the node PCG between the clamping diodes D1C, D2C into a first clamping current iC1 through the first clamping diode D1C, a second clamping current iC2 through the second clamping diode D2C, and a feedback current iF through the series capacitor CS. In general, the clamping diodes D1C, D2C clamp the voltage VC generated by the global current iG to a voltage determined by the first and second storage capacitors C01, C02.

While arrows for current flow are shown for illustration, it is understood that these currents are alternating currents. In addition, the clamping diodes D1C, D2C are shown as diodes, it is understood that any suitable clamping device, active or passive, can be used. For example, the clamping devices can be provided as controlled power transistors.

Figure 9:
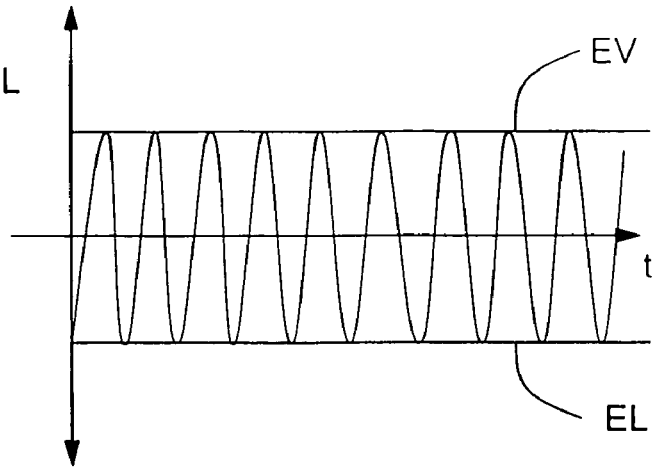
FIG. 9 (PRIOR ART)
FIG. 9 is a graphical depiction of a load current signal generated by a prior art circuit.

Before describing in further detail operation of the inventive circuit, certain disadvantages in known circuits are described. FIG. 9 shows a load current signal iL for a lamp energized by a conventional resonant inverter, for example, having at least one storage capacitor. As is well known to one of ordinary skill in the art, the prior art load current iL has an flat signal envelope EU, EL determined by the storage capacitors. Charge flows to the storage capacitors via the rectifier diodes. While this arrangement is effective to energize the load adequately, the efficiency is less than optimal as the power transfer operation is not linear.

Figure 10:
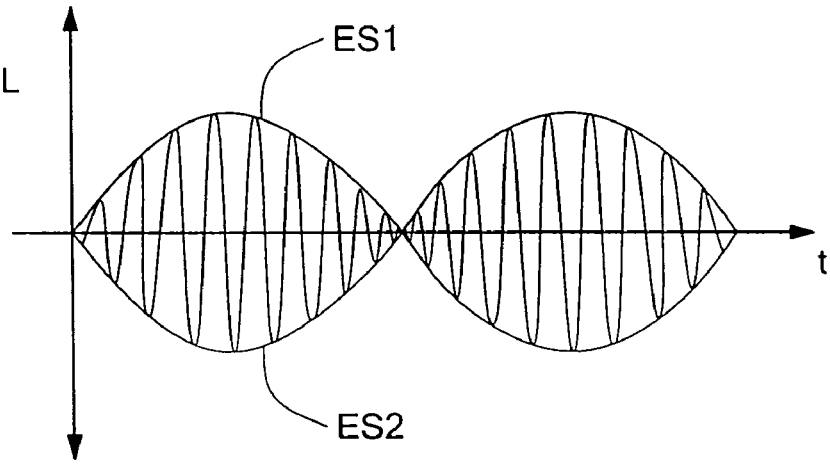
FIG. 10 is a graphical depiction of a linear load current signal generated by a circuit in accordance with the present invention.

In contrast as shown in FIG. 10, the inventive circuit 200 provides a load current signal iL having an envelope ES1, ES2 defined by an input signal, such as a conventional 60 Hz line signal. The high frequency load current iL amplitude tracks the low frequency input signal so as to provide a linear, i.e., resistive load. The advantages of a load current having a substantially sinusoidal envelope will be readily apparent to one of ordinary skill in the art.

Figure 11:
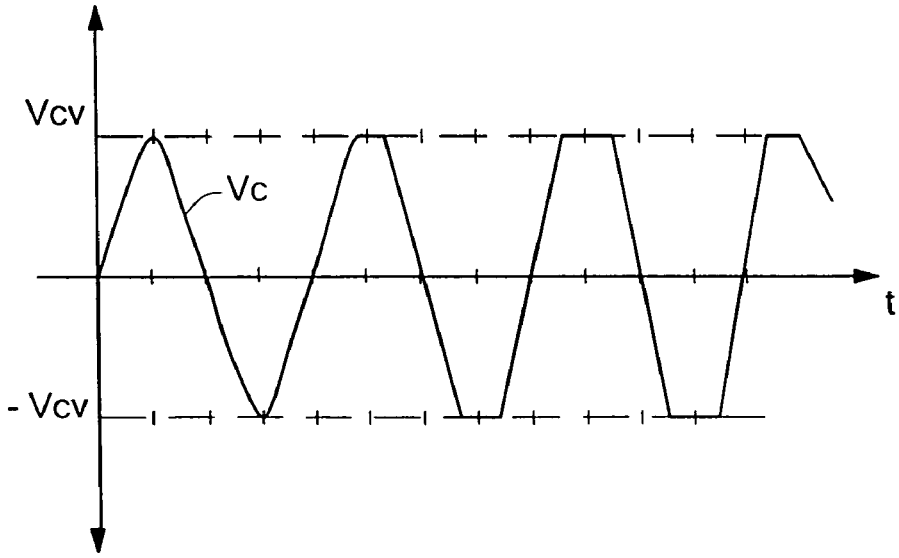
FIG. 11 is a graphical display of a voltage signal at a node in the circuit of FIG. 8.
Figure 12:
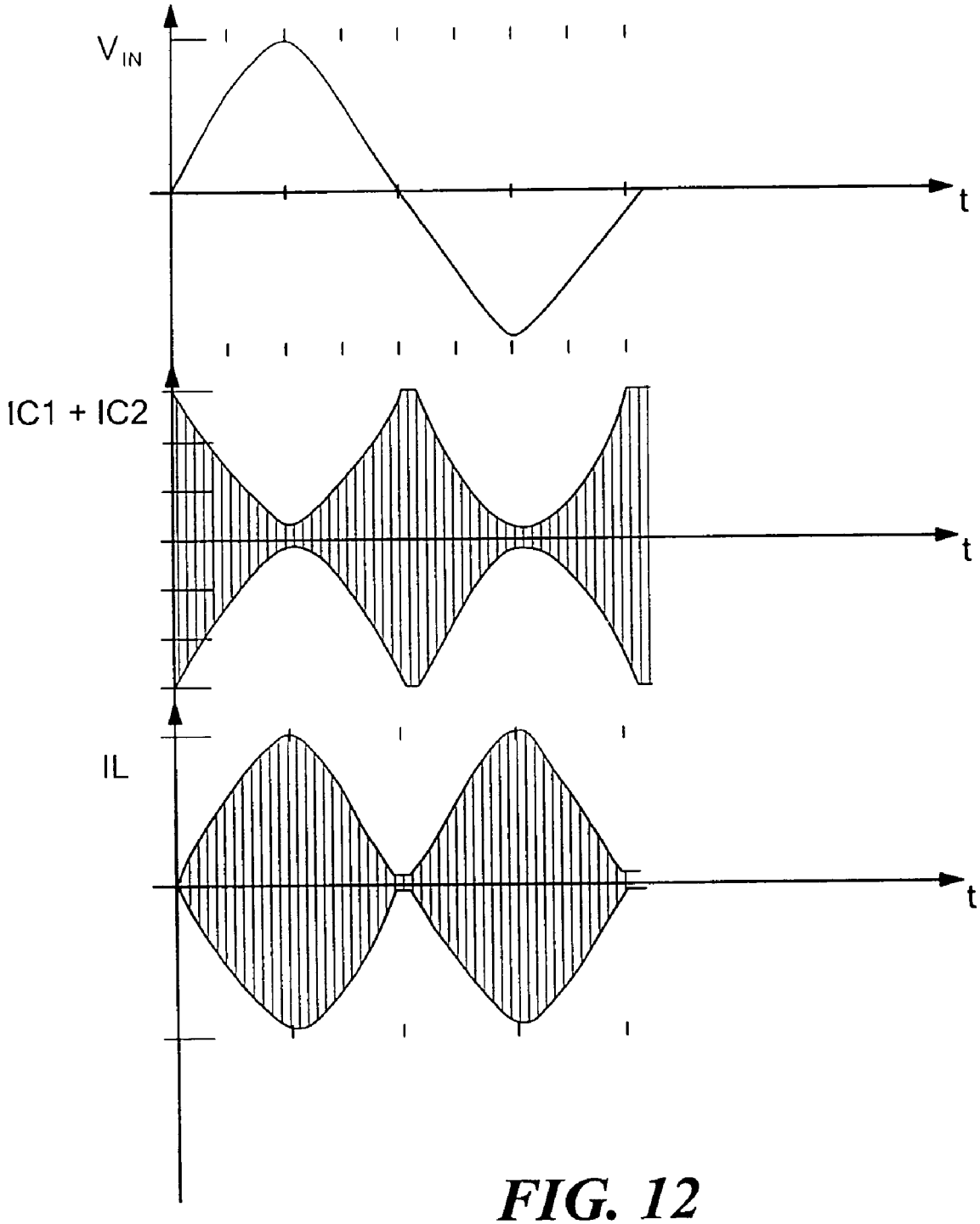
FIG. 12 is a graphical depiction showing a relationship between an input voltage signal, a feedback current signal, and a load current signal.

FIG. 11, in conjunction with FIG. 8, shows the voltage signal VC at the point PCG between the first and second clamping diodes D1C, D2C. As can be seen, the VC voltage signal is clamped to a level VCV set by the charge stored in the first and second storage capcitors C01, C02. FIG. 12 shows the total clamping current iC1+iC2 signal having a signal envelope that is opposite of that of the input voltage signal. As can be seen, iG=iC1+iC2+iF. The instantaneous voltage envelope at point PFB is the same as the input voltage signal VIN since the input inductor L1 is substantially a short circuit at low frequencies, such as 60 Hz. When the input voltage VIN goes to the zero crossing, the voltage drop across the series capacitor CS, which is the difference between the fixed and variable voltages, will force the highest amount of total clamping current. While when the input voltage VIN goes to the peak, it will generate the lowest amount of total clamping current. Thus, the difference between the voltage at node VC and the instantaneous input voltage VIN generates the clamping current iC1+iC2, as shown in FIG. 12. The load current IL is also shown. The impedance of the series capacitor CS determines amount of the feedback current iF. Since the high frequency feedback current IF is constant in amplitude, because of the high impedance of the notch filter L1 and CP, the load current envelope is a generally reverse replica of the envelope of the total clamping current iC1+iC2, thus making it similar to the shape of the input voltage VIN.

While the series capacitor CS is shown as a capacitive element, it is understood that a variety of devices can be used to select a desired impedance for a particular application. For example, particular applications may substitute a component for the series capacitor having an impedance that is not primarily capacitive. This is equally applicable to other circuit components shown in the exemplary embodiments described herein.

With this arrangement, the high frequency load current iL generated by the resonant circuit tracks the sinusoidal input voltage VIN to provide linear circuit operation and thereby enhance the overall efficiency of the circuit. The load current iL tracks the input voltage VIN even in the presence of the storage capacitors, which can sustain resonant circuit operation during zero crossings.

The enhanced efficiency provided by the linear load current is quite advantageous for operations where heat dissipation is an issue, such as dimmable reflectors. The inventive circuit provides less heat, less component stress, and lower EMI (electromagnetic interference).

Figure 13:
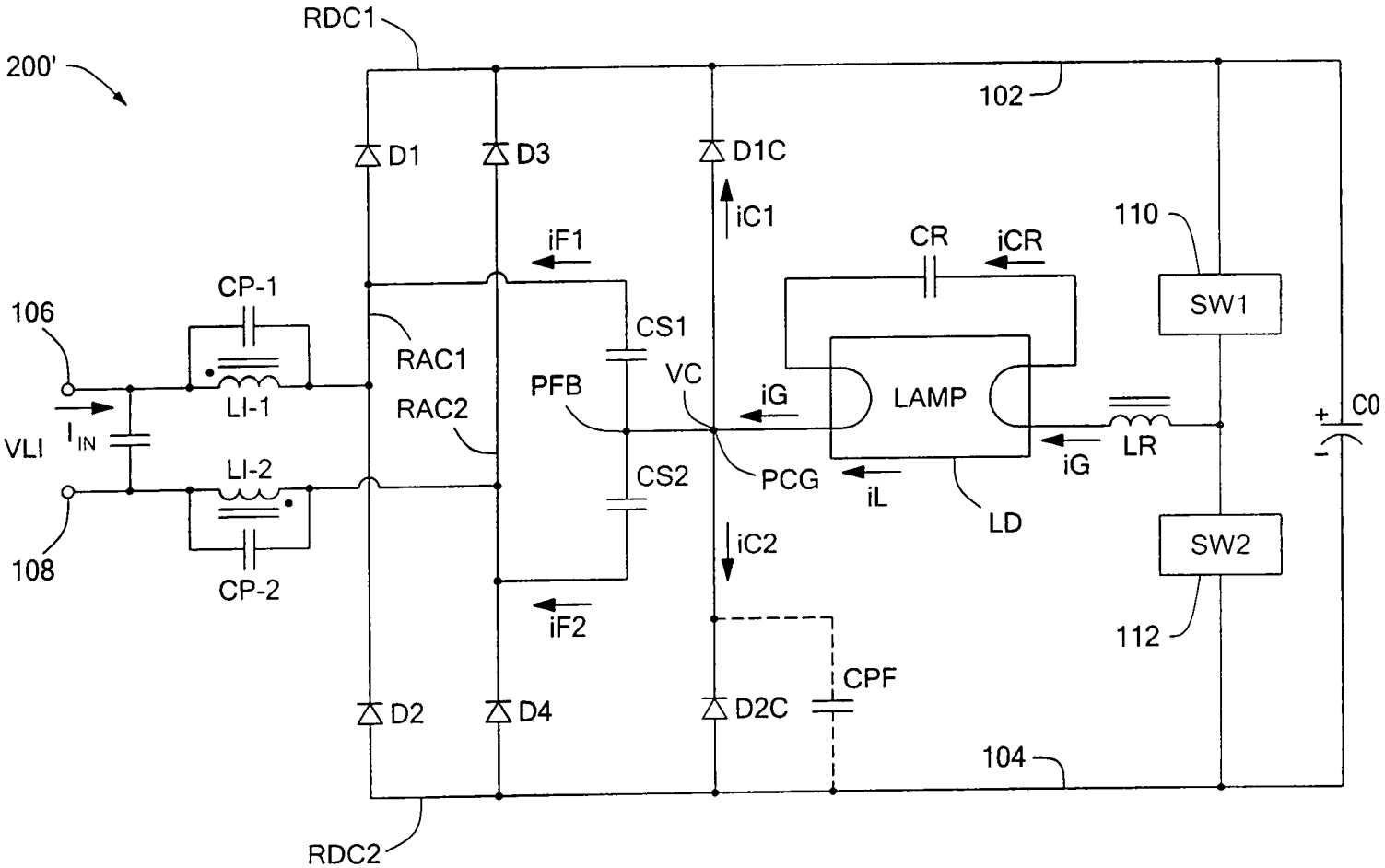
FIG. 13 is a schematic depiction of an exemplary circuit having clamped feedback in accordance with the present invention.

FIG. 13 shows a further resonant circuit 200' having clamped feedback in accordance with the present invention. The resonant circuit 200' has commonality with FIG. 3 and FIG. 8 where like reference numbers indicate like elements. The circuit 200' of FIG. 13 is similar to the circuit 200 of FIG. 8 while having a full bridge rectifier.

Since the circuit 200' has first and second series capacitors CS1, CS2, the feedback current splits into a first feedback current signal iF1 through the first series capacitor CS1 and a second feedback current signal iF2 through the second series capacitor CS2 back to respective nodes RAC1, RAC2 in the full bridge rectifier. Operation of the circuit 200' will be readily understood by one of ordinary skill in the art in view of the previous descriptions of at least the circuits of FIGS. 3 and 8.

Figure 14:
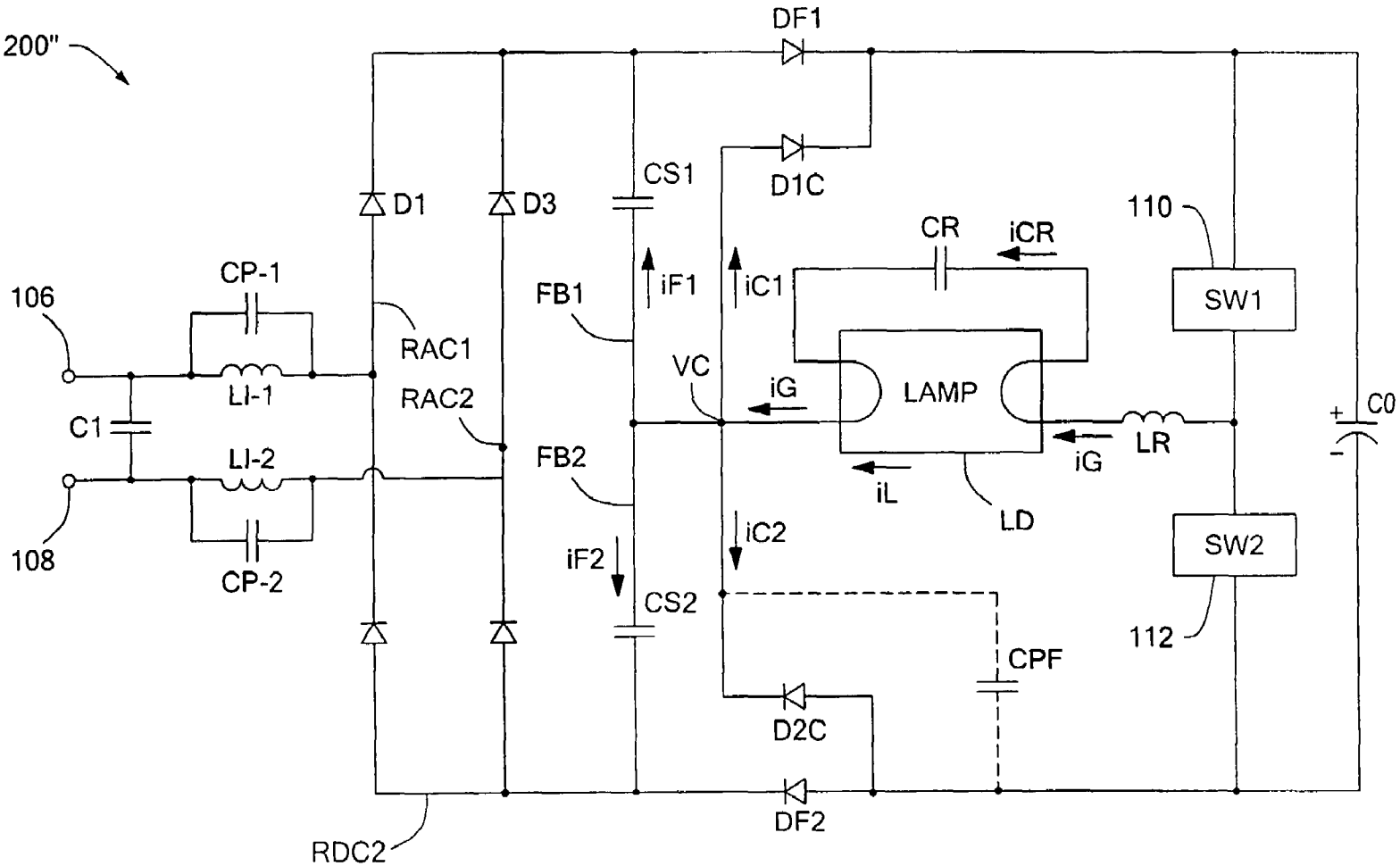
FIG. 14 is a schematic depiction of an exemplary circuit having clamped feedback in accordance with the present invention.

FIG. 14 shows a further embodiment of a resonant circuit 200" having clamped feedback in accordance with the present invention. The circuit 200" has commonality with the circuit of FIG. 4 as well as FIGS. 8 and 13, where like reference numbers indicate like elements. First and second clamping diodes D1C, D2C are coupled end-to-end to the cathodes of the respective first and second bridge diodes DF1, DF2. Operation of this circuit will be readily understood in view of the circuits of FIGS. 4, 8, and 11.

Figure 15:
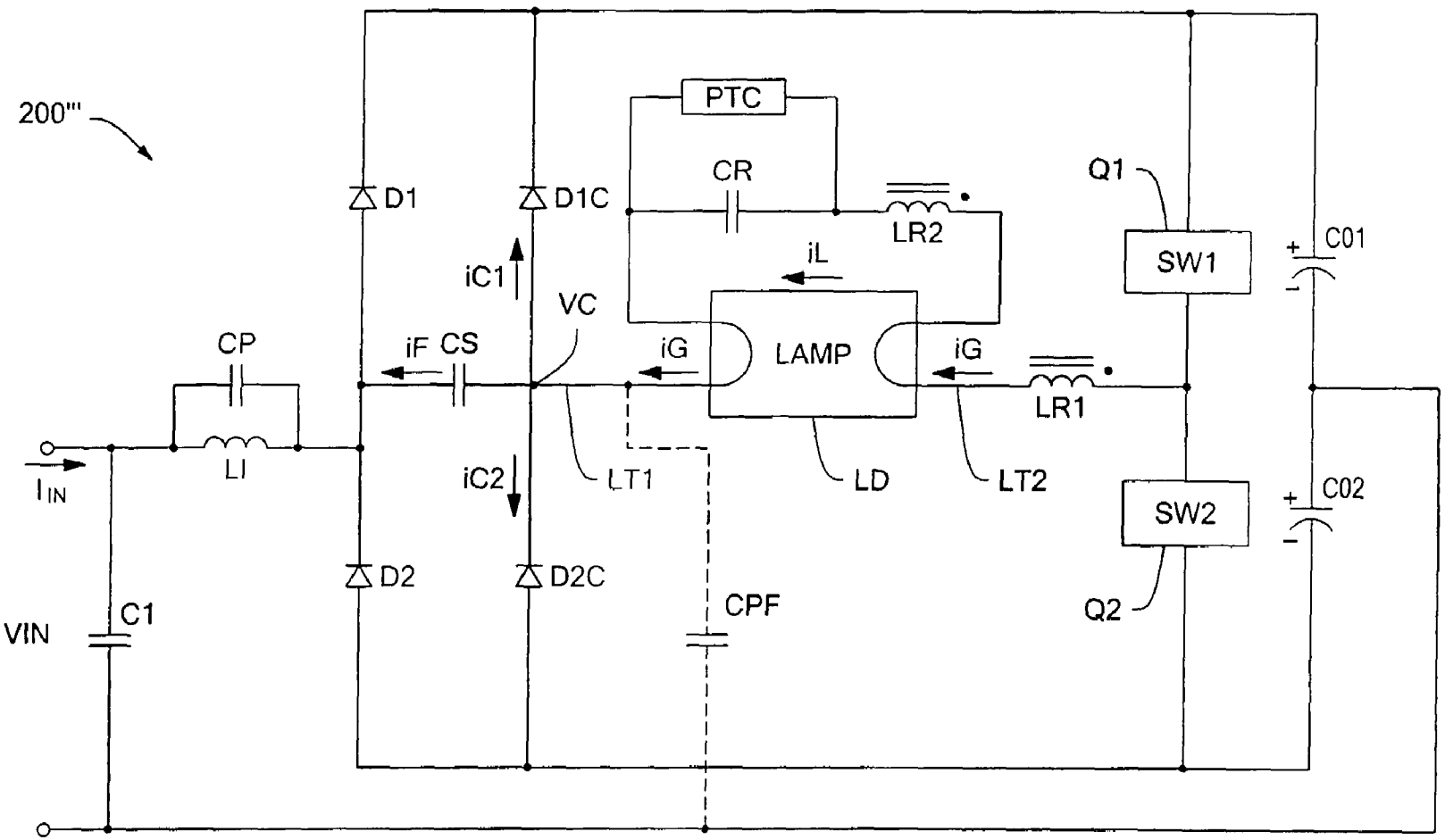
FIG. 15 is a schematic depiction of an exemplary circuit having clamped feedback in accordance with the present invention.

FIG. 15 is another embodiment of a resonant circuit 200''' having clamped feedback in accordance with the present invention. The circuit 200''' includes commonality with the circuit of FIG. 5 as well as the circuit 200 of FIG. 8.

Figure 16:
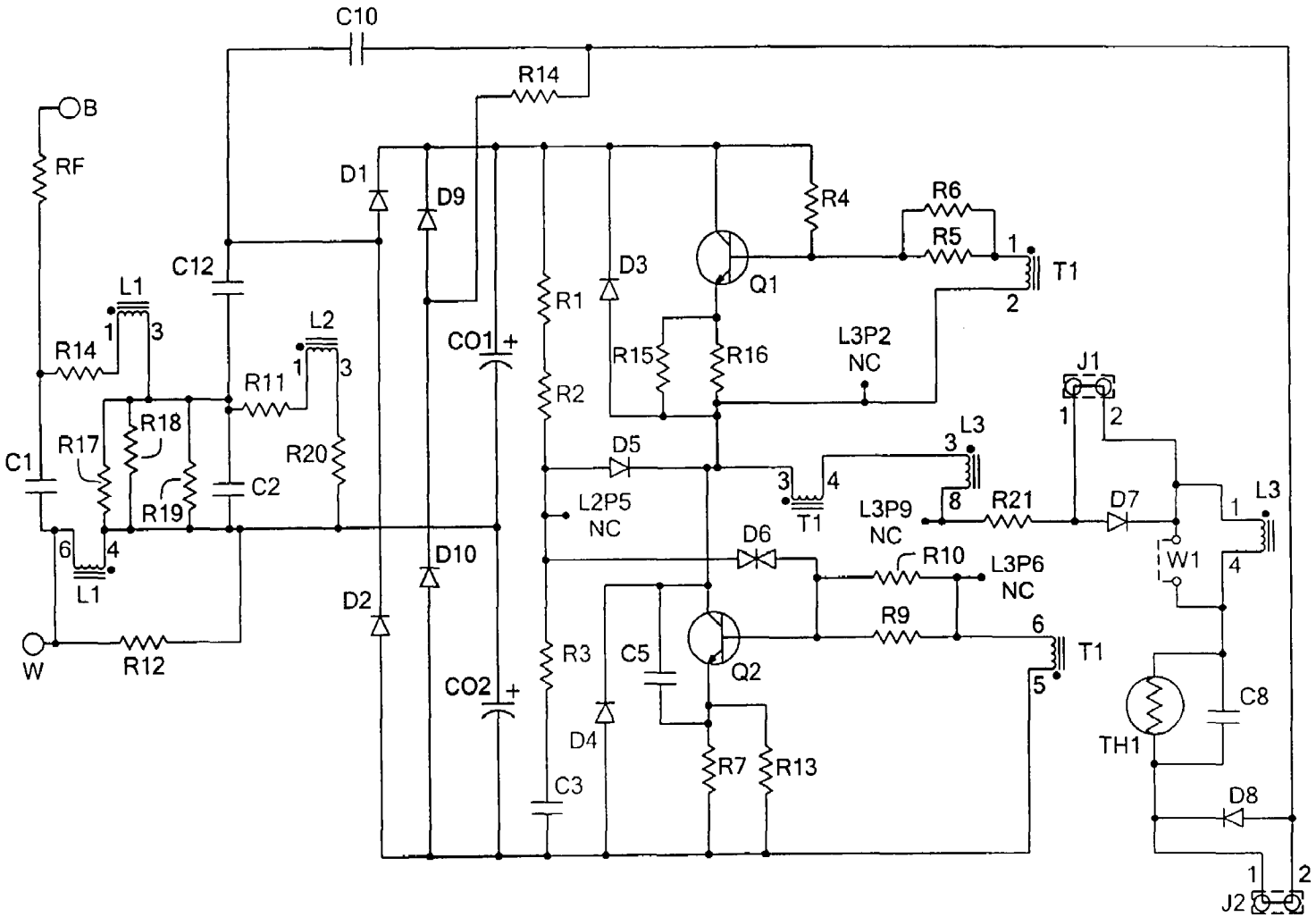
FIG. 16 is an exemplary circuit diagram for the circuit of FIG. 15 in accordance with the present invention.

FIG. 16 shows a circuit diagram for an exemplary implementation of the resonant circuit 200''' of FIG. 15. FIG. 17 shows exemplary component values for the elements of the circuit of FIG. 16

In each of the circuits of FIGS. 8, 13, 14 and 15 an optional feedback adjustment impedance, here shown as a capacitor CDF, can be provided to tweak the feedback current signal iF. It is understood that the impedance can be provided by a wide range of circuit components, both active and passive, having the desired impedance characteristic.

It is understood that the inventive circuits described above with clamped feedback are useful in a wide range of applications. One such application is dimming circuits that adjust a light output level to desired level. While a flat load current may provide some dimming functionality, the advantages provided by a linear load current will be readily apparent to one of ordinary skill in the art.

Figure 18:
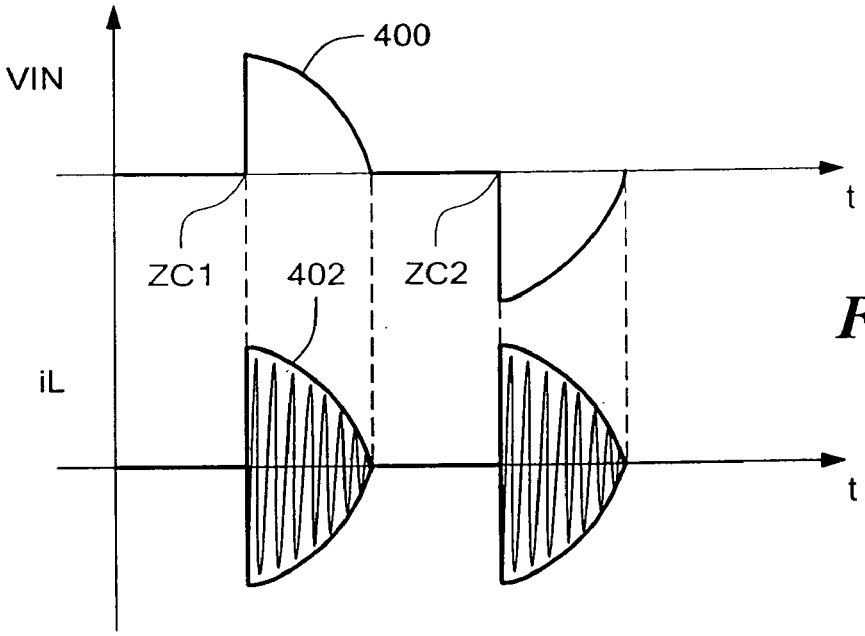
FIG. 18 is a graphical depiction of a load current signal and an input voltage signal for a dimming application in accordance with the present invention.
Figure 19:
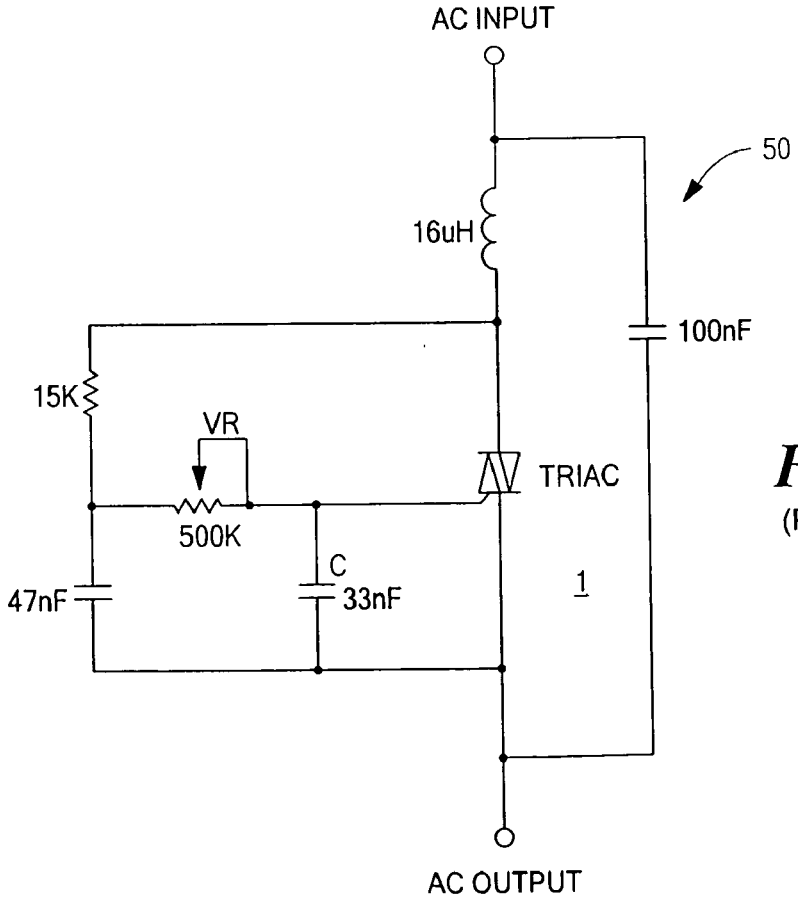
FIG. 19 (PRIOR ART)
FIG. 19 is a schematic diagram of an exemplary prior art dimming circuit.
Figure 19A:
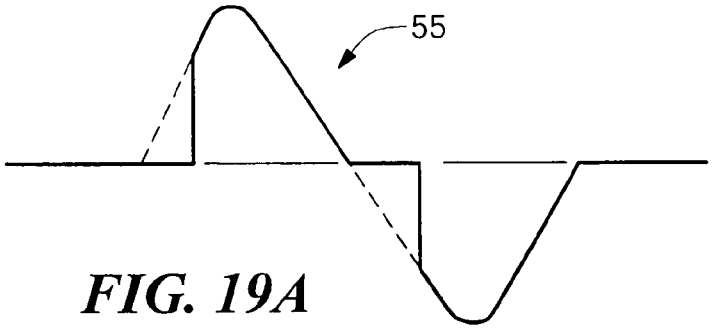
FIG. 19A (PRIOR ART)
FIG. 19A is a graphical depiction of a dimming signal provided by the prior art circuit of FIG. 19.

FIG. 18 shows exemplary waveforms 400, 402 for a dimming application in accordance with the present invention. Dimming circuits providing a dimming input voltage signal 400 are well known in the art. Known circuits for providing a dimming signal are typically triac-based. At a predetermined point, the triac turns on and stays on until the zero crossing ZC1 to energize the load circuit, such as the circuit 200 of FIG. 8. The input signal is off until the triac fires again and stays on until the next zero crossing ZC2. An exemplary prior art dimming circuit 50 is shown in FIG. 19 and a dimming signal output 55 is shown in FIG. 19A. U.S. Pat. No. 6,603,274, which is incorporated herein by reference, also discloses dimming circuits.

Referring again to FIG. 18, the load current 402 in the inventive clamping circuit, such as the circuit 200 of FIG. 8, has en envelope that tracks the input voltage signal. With this arrangement, the load current signal iL is linear when the circuit is energized by the dimming circuit. In a fluorescent lighting application for example, dimming of a fluorescent lamp is comparable to that of an incandescent lamp. One skilled in the art will recognize the advance provided in such an application.

Figure 20:
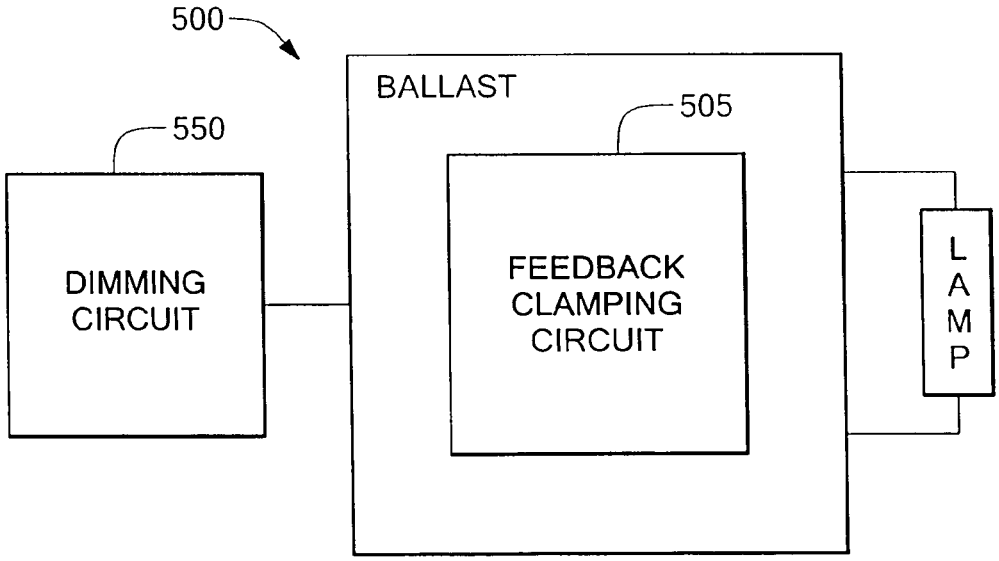
FIG. 20 is a schematic depiction of a ballast having clamped feedback in accordance with the present invention.

FIG. 20 shows an exemplary ballast 500 having a dimming circuit 550 providing an input signal to a feedback clamping circuit 505. It is understood that the clamping circuit 505 can be provided as the circuit 200 of FIG. 8, for example. The ballast 500 energizes a fluorescent lamp and provides enhanced dimming of the lamp.

The present invention provides a circuit and method to clamp global load feedback such that the load current signal has an envelope the substantially tracks an input voltage signal. This arrangement enhances linear operation of the circuit so as to concomitantly increase efficiency. While the invention is described in conjunction with ballast circuits for fluorescent lamps, it is understood that the invention is applicable to a wide range of circuits in which it is desirable to promote linear operation. In addition, while the exemplary embodiments include storage capacitors to sustain the circuit through zero crossings for example, it is contemplated that circuits ultimately may not need storage capacitors.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

The invention claimed is:

1. A circuit comprising:

a converter circuit including first and second input terminals, a rectifier circuit coupled to the first and second input terminals, a resonant inductor, a resonant capacitor, first and second voltage rails, and at least first and second load terminals to energize a load;

first and second clamping devices coupled so as to provide a circuit path between the first and second voltage rails; and a first series capacitor having a first terminal coupled to a point between the first and second clamping devices and a second terminal coupled to the first input terminal to provide a feedback path for a feedback current such that a load current has a signal envelope substantially tracking an input voltage signal on the first and second input terminals.

2. The circuit according to claim 1, further including a feedback current adjusting component coupled across a first one of the first and second clamping devices.

3. The circuit according to claim 1, further including at least one storage capacitor coupled to the first and/or second voltage rails.

4. The circuit according to claim 3, wherein a load current splits at the point between the first and second clamping devices into a first clamp current to the first clamping device, a second clamp current to the second clamping device, and a feedback current to the series capacitor.

5. The circuit according to claim 4, further including at least one feedback current adjusting component coupled across a first one of the first and second clamping devices such that the load current further splits into a current to the feedback current adjusting component.

6. The circuit according to claim 5, wherein the feedback current adjusting component includes a capacitor.

7. The circuit according to claim 1, wherein the first and second clamping devices include diodes.

8. The circuit according to claim 1, wherein the rectifier circuit includes a voltage doubling configuration having first and second diodes coupled end-to-end across the first and second voltage rails.

9. The circuit according to claim 1, wherein the rectifier circuit includes a full-wave rectifying circuit and the circuit further includes a second series capacitor to provide a further feedback path from the point between the first and second clamping devices.

10. The circuit according to claim 9, further including a first bridge diode coupled between the first clamping device and the rectifier circuit and a second bridge diode coupled between the second clamping device and the rectifier circuit.

11. The circuit according to claim 1, further including a positive temperature coefficient device coupled in parallel with the resonant capacitor.

12. The circuit according to claim 1, further including an input inductor coupled between the first input terminal and the series capacitor and a blocking capacitor coupled in parallel to the input inductor to form a notch filter corresponding to a frequency of the load signal.

13. The circuit according to claim 12, further including a first capacitor coupled between the first and second input terminals.

14. The circuit according to claim 1, further including a dimming circuit coupled to the circuit.

15. The circuit according to claim 1, wherein the circuit includes a ballast to energize a lamp.

16. A resonant circuit to energize a load, comprising:

a first circuit loop including a first clamping device, a series capacitor, and a first rectifying diode;

a second circuit loop including a second clamping device, and a second rectifying diode;

a third circuit loop including the first clamping device, first and second load terminals through which load current flows through the load when the load is present, a resonant inductor, and a first switching device;

a fourth circuit loop including the second clamping device, the first and second load terminals, the resonant inductor, and a second switching device;

a resonant capacitor coupled in parallel with the load when the load is present;

a first input terminal coupled to the series capacitor; and a second input terminal coupled to the series capacitor, wherein the load current has a signal envelope substantially tracking an input voltage signal on the first and second input terminals when the load is present and the input voltage signal is present.

17. The circuit according to claim 16, further including a fifth circuit loop including the second clamping device and a feedback adjusting element.

18. The circuit according to claim 16, further including a fifth circuit loop including the first clamping device and a feedback adjusting element.

19. The circuit according to claim 16, further including a fifth circuit loop including the first and second switching devices and first and second storage capacitors.

20. The circuit according to claim 16, further including an input inductor coupled between the series capacitor and the first input terminal and a blocking capacitor coupled in parallel with the input inductor such that the input inductor and the blocking capacitor provide a notch filter at a frequency of the load current.

21. The circuit according to claim 16, further including a blocking capacitor and a fifth circuit loop including an input inductor, the second rectifying diode, a storage capacitor and a capacitor, wherein the blocking capacitor is coupled in parallel with the input inductor.

22. A resonant circuit, comprising:

a first circuit loop including first, second, third and fourth rectifying diodes coupled to form a full bridge rectifier;

a second circuit loop including the third and fourth rectifying diodes and first and second clamping devices;

a third circuit loop including the third rectifying diode, the first clamping device and a first series capacitor;

a fourth circuit loop including the fourth rectifying diode, the second clamping device and a second series capacitor;

a fifth circuit loop including first and second load terminals to energize a load when present, a resonating inductor, a first switching device, and the first clamping device;

a sixth circuit loop including the first and second load terminals, the resonating inductor, a second switching device, and the second clamping device; and a first input terminal coupled to a point between the first and second rectifying diodes and a second input terminal coupled to a point between the third and fourth rectifying diodes, wherein a load current has a signal envelope that tracks an input voltage signal on the first and second input terminals.

23. The circuit according to claim 22, further including a device coupled across the second clamping device to adjust a feedback current through the first and second series capacitors.

24. The circuit according to claim 22, further including a device coupled across the first clamping device to adjust a feedback current through the first and second series capacitors.

25. The circuit according to claim 22, further including a first input inductor coupled between the first input terminal and the point between the first and second rectifying diodes and a first capacitor coupled across the first input inductor and a second input inductor coupled between the second input terminal and the point between the third and fourth rectifying diodes to provide a notch filter having a frequency corresponding to a frequency of a load current.

26. The circuit according to claim 22, further including a seventh circuit loop including a storage capacitor, and the first and second switching devices.

27. A resonant circuit, comprising:

a first circuit loop including first, second, third and fourth rectifying diodes coupled to form a full bridge rectifier;

a second circuit loop including first and second series capacitors and the third and fourth rectifying diodes;

a third circuit loop including the first series capacitor, a first clamping device, and a first bridge diode;

a fourth circuit loop including the second series capacitor, a second clamping device and a second bridge diode;

a fifth circuit loop including the first clamping device, first and second load terminals to energize a load when present, a resonant inductor, and a first switching device;

a sixth circuit loop including the second clamping device, the first and second load terminals, the resonant inductor and a second switching device;

a first input terminal coupled to a point between the first and second rectifying diodes and a second input terminal coupled to a point between the third and fourth rectifying diodes, wherein a load current has a signal envelope that tracks an input voltage signal on the first and second input terminals.

28. The circuit according to claim 27, further including a device coupled across the second clamping device to adjust a feedback current through the first and second series capacitors.

29. The circuit according to claim 27, further including a device coupled across the first clamping device to adjust a feedback current through the first and second series capacitors.

30. The circuit according to claim 27, further including a storage capacitor coupled to the first and second bridge diodes.

31. The circuit according to claim 27, further including a resonant capacitor coupled across the first and second load terminals.

32. A resonant circuit, comprising:

a rectifying circuit to receive an AC input voltage signal;

a feedback path from a load to the rectifying circuit;

a feedback clamping means coupled to the load for providing a load current signal having a signal envelope that substantially tracks the input voltage signal.

33. The circuit according to claim 32, further including at least one storage capacitor coupled to the rectifying circuit.

34. The circuit according to claim 32, wherein the feedback clamping means includes first and second clamping diodes.

35. The circuit according to claim 32, further including a notch filter coupled to the rectifying circuit wherein the notch filter has a frequency corresponding to a frequency of the load current signal.

36. The circuit according to claim 32, further including a series capacitor means coupled between the feedback clamping means and the rectifying circuit.

37. A method of generating a linear load in a circuit, comprising:

coupling a feedback signal representative of a load current signal to a rectifying circuit; and clamping a voltage of the feedback signal to a predetermined level such that a load current signal has an envelope that substantially tracks an input AC voltage signal.

38. The method according to claim 37, further including coupling first and second clamping devices end-to-end across first and second voltage rails.

39. The method according to claim 37, further including providing the input AC voltage signal as a dimming signal.

* * * * *